US005209585A

United States Patent [19]

Yamamoto et al.

[11] Patent Number: 5,209,585

[45] Date of Patent: May 11, 1993

[54] PRINT HEAD FOR A DOT MATRIX PRINTER

[75] Inventors: Tetsuya Yamamoto; Yukihisa Kato; Masao Kunita, all of Tanashi, Japan

[73] Assignee: Citizen Watch Co., Ltd., Tokyo, Japan

[21] Appl. No.: 539,688

[22] Filed: Jun. 18, 1990

[30] Foreign Application Priority Data

Jun. 19, 1989 [JP] Japan ..... 1-70742[U]

[51] Int. Cl.[5] ..... B41J 2/235

[52] U.S. Cl. ..... 400/124; 101/93.05

[58] Field of Search ..... 400/124; 101/93.05

[56] References Cited

U.S. PATENT DOCUMENTS 4,105,940 8/1979 Cacciola ..... 400/124
4,197,021 4/1980 Herbert ..... 400/124
4,382,701 5/1983 Davenport ..... 400/124
4,502,799 3/1985 Weeks et al. ..... 400/124
5,033,884 7/1991 Yamada et al. ..... 400/124
5,039,236 8/1991 Masuda et al. ..... 400/124
5,088,844 2/1992 Takeuchi et al. ..... 400/124

*Primary Examiner*—Edgar S. Burr
*Assistant Examiner*—John S. Hilten
*Attorney, Agent, or Firm*—Birch, Stewart, Kolasch & Birch

[57] ABSTRACT

A print head for a dot matrix printer has a plurality of print needles slidably mounted in the head, a plurality of armatures operatively connected to the print needles, a plurality of electromagnets for respectively operating the armatures, a center ring for stopping the armature attracted by the electromagnet, and a residual sheet mounted on a core of each of the electromagnets for preventing the armature from sticking to the core.

2 Claims, 2 Drawing Sheets

PRINT HEAD FOR A DOT MATRIX PRINTER

BACKGROUND OF THE INVENTION

The present invention relates to a print head for a dot matrix printer of an armature attracting type in which an electromagnet attracts an armature to move a print needle for a printing operation, and more particularly, to a structure for regulating the position of the armature at the impact of printing.

In the print head of the attracting type, there are problems in order to increase the printing speed and impact force. One of the problems is that a tip end of the print needle scratches an inked ribbon. In order to prevent the scratching of the inked ribbon, it is necessary to reduce the period of time the print needle contacts the inked ribbon. Namely, if the retraction of the print needle from the ribbon is delayed during high speed printing, the tip end may scratch the ribbon. In particular, when the print gap between the end of the print needle and the printing paper is set at a larger value than a predetermined value for some reason, the scratching of the inked ribbon is liable to occur as describe hereinafter.

Japanese Utility Model Applications Laid-open 61-100536 (hereinafter called first prior art) and 62-27330 (hereinafter called second prior art) disclose print heads each having stopper means.

The print head of the first prior art has a center ring as a stopper. If the print gap is set large, the armature moving to the platen strikes against the center ring, so that the armature is stopped.

In the print head of the second prior art, a nonmagnetic residual sheet is provided on a core of a solenoid corresponding to a plunger secured to the armature. When a solenoid is excited, the plunger is attracted to the core. In the case of large print gap, the plunger strikes against the residual sheet, so that the position of the armature is regulated at the same time as printing.

In the first prior art, when the armature strikes against the center ring, the armature is deflected by the inertia with the center ring or after the print needle impacts the printing paper. As a result, the gap between the core and the plunger is reduced by the magnitude of the deflection of the armature or becomes zero. On the other hand, although the current applied to the solenoid has been cut off, residual magnetism remains in the core. Accordingly, the armature is attracted to the core which makes it difficult to return the armature to a reset position. Consequently, the print needle scratches the inked ribbon. If the gap between the core and the plunger is increased in order to prevent the plunger from staying at the attracted position, the attracting force of the electromagnet is reduces and hence reduced the impact force of the needle.

In the second prior art, when the plunger strikes the residual sheet, the base end portion of the armature floats from the electromagnet because the plunger is adjacent to the pivot. Consequently, the returning motion of the armature is retarded, so that the scratching of the needle occurs.

SUMMARY OF THE INVENTION

The object of the present invention is to provide a print head wherein scratching of the needle is prevented.

According to the present invention, there is provided a print head for a dot matrix printer having a plurality of print needles slidably mounted in the head, a plurality of armatures corresponding to the print needles, a plurality of electromagnets for respectively operating the armatures, a center ring provided for stopping the moving armature attracted by a corresponding electromagnet, and a residual sheet mounted on a core of each of the electromagnets for preventing the armature from sticking to the core when attracted.

In one aspect of the invention, the residual sheet has a minimum thickness necessary for preventing the sticking of the armature.

These and other objects and features of the present invention will become more apparent from the following detailed description with reference to the accompanying drawings.

DETAILED DESCRIPTION OF THE INVENTION

Figure 1:
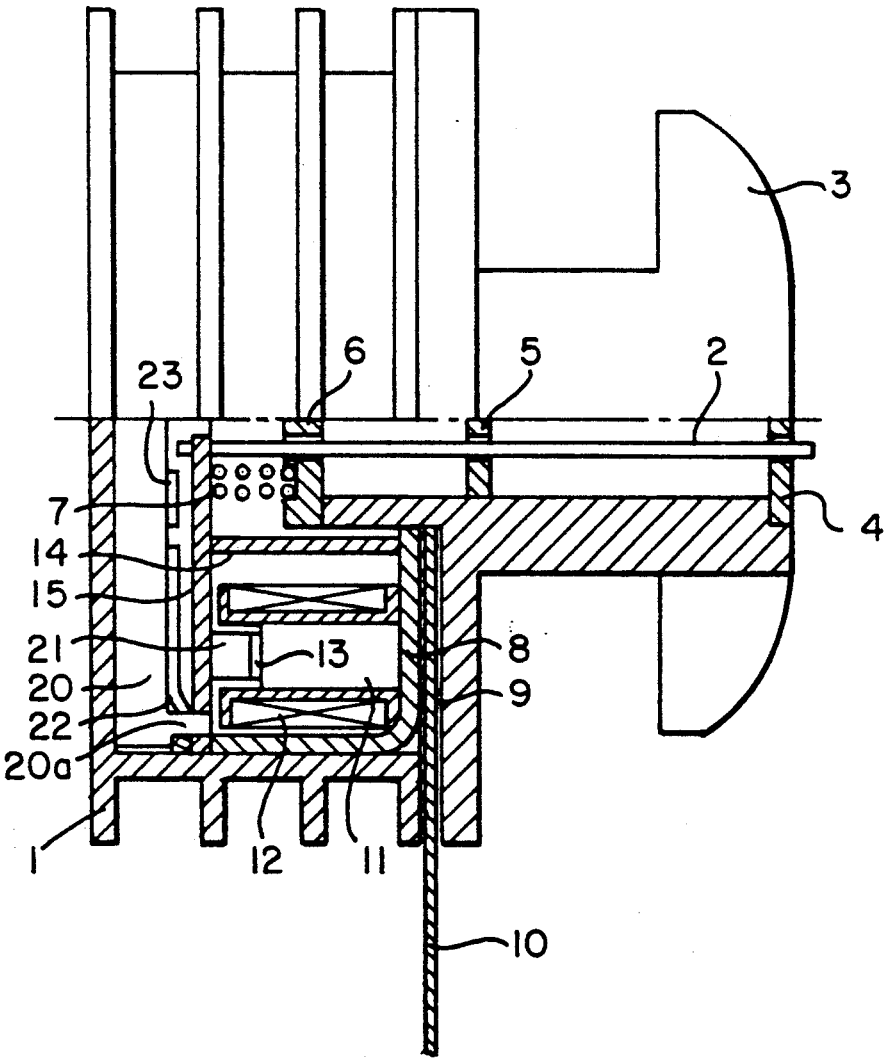
FIG. 1 is a partial sectional side view showing a print head for a dot matrix printer according to the present invention.

Referring to the drawings, a print head comprises a cylindrical heatsink 1 and a print needle guide nose 3. In the nose 3, a front end guide plate 4, an intermediate guide plate 5 and a rear end guide plate 6 are provided.

Figure 2:
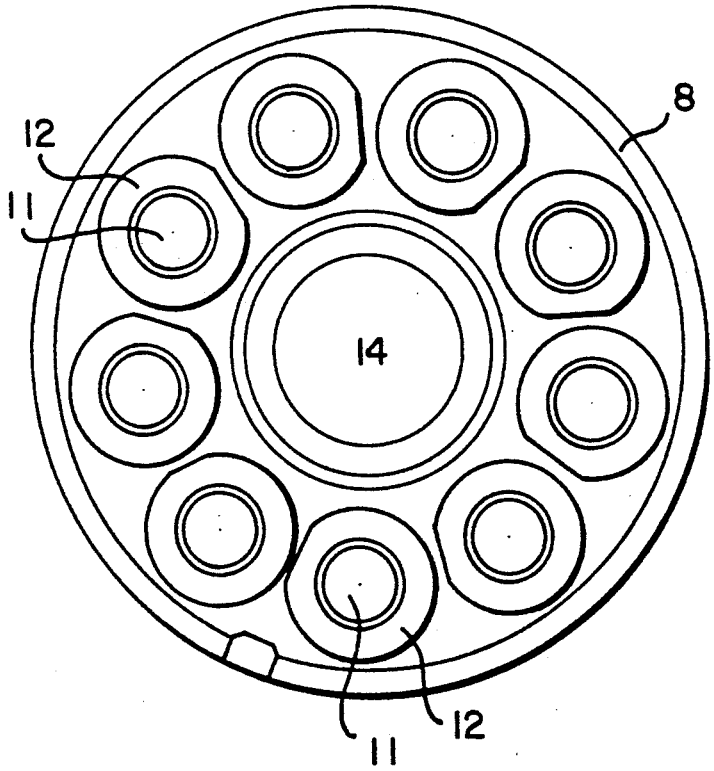
FIG. 2 is a side view showing an electromagnet.

Secured to a base of the heatsink 1 is an armature base 20 on which a plurality of armatures 15 are radially arranged. Each armature 15 has a hole at a base end portion which is engaged with a positioning projection 20*a* formed on the base 20 so as to be pivoted in the axial direction of the print head. A plurality of print needles 2 are slidably supported in the guide plates 4 to 6. Each of the print needles 2 is secured to an actuating end of the armature 15. A return spring 7 is disposed between the end of the armature 15 and the rear end guide plate 6. Thus, the print needle 2 is biased to the rear portion of the print head. A cylindrical and annular yoke 8 is mounted in the heatsink 1 and a base of the cylindrical yoke 8 is engaged with the guide nose 3, with an insulator 9 and a flexible printed wiring board 10 interposed therebetween. On the base of the yoke 8, a plurality of cylindrical cores 11 are circularly disposed corresponding to the armatures 15 and secured to the base. A coil 12 is attached to each core 11 so that an electromagnet is formed (FIG. 2). On the end of the core 11, a residual sheet 13 is attached. The residual sheet 13 is made of nonmagnetic material, such as ferroalloy. A center ring 14 of nonmagnetic material is secure to the yoke 8 by spot welding so as to correspond to an end portion of the armature. A plunger 21 is secured to each armature 15 corresponding to the residual sheet 13 on the core 11. An armature spring 22 is disposed between the base 20 and a base end of the armature 15 to urge the base end to the yoke 8. The actuating end of the armature 15 is urged by the return spring 7 to a stopper 23 secured to the base 20. The heatsink 1 and the guide nose 3 are secured to each other by clamping means (not shown).

The residual sheet 13 has a minimum thickness necessary for preventing the plunger 21 from sticking to the core 11 and for preventing the end portion of the armature from floating from the yoke 8 even if the armature is deflected when the armature strikes the center ring 14, as shown in the FIG. 1.

In operation, when the coil 12 is not excited, the armature 15 is biased to the stopper 23 by the armature spring 22 and the return spring 7. When the coil 12 is excited and the plunger 21 is attracted to the core 11, the armature 15 is pivoted about the projection 20*a* against springs 22 and 7. Assuming that the printing gap is set larger than a proper value, the armature 15 strikes the center ring 14 so that the position of the armature 15 in the impacting direction is regulated. Thus, the print needle 2 secured to the actuating end of the armature 15 slides in the guide plates of the guide nose 3 and the end of the print needle 2 is projected from the guide nose 3 to print a dot on the printing paper mounted on the platen through an inked ribbon. When the coil 12 is de-energized, the armature 15 bounds back to the rest position by the return spring 7, pivoting about the projection 20*a* .

As hereinbefore described, the residual sheet 13 has a minimum thickness necessary for preventing the plunger 21 from sticking to the core 11 by the attraction thereof. When the armature 15 strikes the center ring 14, the armature 15 is deflected so that the plunger 21 is further moved to the core 11 by the inertia of the armature 15 and the plunger 21 itself. However, the plunger 21 abuts on the residual sheet 13 so that the residual sheet 13 prevents a large deflection of the plunger 21 and hence a large deflection of the armature 15 is prevented. Further, the plunger 21 is not attracted to the core 11 by the residual magnetism because of the residual sheet 13. Thus, the armature is rapidly returned to the rest position. As a result, the needle 2 does not scratch the inked ribbon. Therefore, the gap between the core 11 and the plunger 21 can be determined regardless of the deflection. Consequently, the impact force and the printing operation cycle are not reduced, due to a proper gap. Since the print needle 2 quickly returns from the printing paper immediately after printing, the scratching of the inked ribbon does not occur.

In accordance with the present invention, a print head has a center ring for regulating the position of the armature in the impacting direction and a residual sheet for preventing the plunger from sticking to the core, so that the armature quickly returns immediately after the printing. Therefore, scratching of the inked ribbon is prevented even if the printing gap is large.

While the invention has been described in conjunction with preferred specific embodiment thereof, it will be understood that this description is intended to illustrate and not limit the scope of the invention, which is defined by the following claims.

What is claimed is:

1. A print head for a dot matrix printer of an armature attracting type, comprising a plurality of print needles slidably mounted in said print head at a central portion thereof, a plurality of armatures pivotally mounted in said print head, a front side face at an end portion of each of said armatures being adjacent a rear end of a corresponding print needle, a plunger secured to the front side of each armature, a plurality of electromagnets each having a core surrounded by a coil, each core corresponding to each respective plunger, so that said plunger of said armature is attracted to said core, thereby moving the corresponding needle for printing a dot, a residual sheet made of non-magnetic metal, mounted on each of said cores of each of said electromagnets, and a center ring made of non-magnetic metal provided at a central portion of said print head adjacent to an end portion of each armature for stopping said armature when said armature strikes the center ring responsive to the attraction of said electromagnet, said residual sheet having a thickness such that when said armature strikes said center ring, said plunger of said armature is spaced from said residual sheet, said plunger subsequently contacting said residual sheet due to deflection of said armature caused by inertia thereof responsive collision of said armature against said center ring, said center ring and said residual sheet prevention said armature from sticking to said core of said electromagnet.

2. The print head according to claim 1, wherein each plunger of said respective armature corresponds to said residual sheet on each respective core.

* * * * *

UNITED STATES PATENT AND TRADEMARK OFFICE

CERTIFICATE OF CORRECTION

PATENT NO. : 5,209,585

DATED : May 11, 1993

INVENTOR(S) : Tetsuya Yamamoto; Yukihisa Kato; Masao Kunita

It is certified that error appears in the above-identified patent and that said Letters Patent is hereby corrected as shown below:

Column 4, line 36, change "responsive" to --responsive to--

Column 4, line 38, change "prevention" to --preventing--

Signed and Sealed this

First Day of February, 1994

Bruce Lehman

*Attest:*

BRUCE LEHMAN

*Attesting Officer*

*Commissioner of Patents and Trademarks*